US008284900B2

(12) United States Patent
Rogers et al.

(10) Patent No.: US 8,284,900 B2
(45) Date of Patent: Oct. 9, 2012

(54) APPARATUS AND METHOD FOR IMPROVED TRANSIENT RESPONSE IN AN ELECTROMAGNETICALLY CONTROLLED X-RAY TUBE

(75) Inventors: Carey Shawn Rogers, Brookfield, WI (US); Mark Alan Frontera, Ballston Lake, NY (US); Ethan James Westcot, Wauwatosa, WI (US); Aparna Chakrapani Sheila-Vadde, Bangalore, IN (US); Peter Andras Zavodszky, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 210 days.

(21) Appl. No.: 12/911,893

(22) Filed: Oct. 26, 2010

(65) Prior Publication Data

US 2012/0099700 A1 Apr. 26, 2012

(51) Int. Cl.
*H01J 35/30* (2006.01)

(52) U.S. Cl. ..... 378/137; 378/121

(58) Field of Classification Search ..... 378/4–20, 378/62, 119–144

See application file for complete search history.

(56) References Cited

U.S. PATENT DOCUMENTS

| | | | | |
|---|---|---|---|---|
| 6,128,367 | A | 10/2000 | Foerst et al. | 378/137 |
| 6,292,538 | B1 | 9/2001 | Hell et al. | 378/137 |
| 2002/0186816 | A1 | 12/2002 | Freudenberger et al. | 378/144 |
| 2010/0020937 | A1 | 1/2010 | Hautmann et al. | 378/137 |

FOREIGN PATENT DOCUMENTS

WO 2008155695 A1 12/2008

OTHER PUBLICATIONS

Schwartz, "Brazing: for the engineering technologist," Springer, 1995, p. 297.

*Primary Examiner* — Courtney Thomas

(74) *Attorney, Agent, or Firm* — Ziolkowski Patent Solutions Group, SC

(57) ABSTRACT

An x-ray tube assembly includes a vacuum enclosure including a cathode portion, a target portion, and a throat portion. The throat portion includes a magnetic field section, upstream section, and downstream section. The magnetic field section has a first susceptibility to generate eddy currents in the presence of a magnetic field intensity. The upstream section is coupled to the cathode portion and the magnetic field section and has a second susceptibility to generate eddy currents in the presence of the magnetic field intensity. The downstream section is coupled to the magnetic field section and has a third susceptibility to generate eddy currents in the presence of the magnetic field intensity. The first susceptibility to generate eddy currents is less than the second and third susceptibilities to generate eddy currents. The assembly includes a target within the target portion, and a cathode within the cathode portion.

20 Claims, 5 Drawing Sheets

APPARATUS AND METHOD FOR IMPROVED TRANSIENT RESPONSE IN AN ELECTROMAGNETICALLY CONTROLLED X-RAY TUBE

BACKGROUND OF THE INVENTION

Embodiments of the invention relate generally to diagnostic imaging and, more particularly, to an apparatus and method for improved transient response in an electromagnetically controlled x-ray tube.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating target structure for the purpose of distributing the heat generated at a focal spot. The target is typically rotated by an induction motor having a cylindrical rotor built into a cantilevered axle that supports a disc-shaped target and an iron stator structure with copper windings that surrounds an elongated neck of the x-ray tube. The rotor of the rotating target assembly is driven by the stator.

One skilled in the art will recognize that the operation described herein need not be limited to a single X-ray tube configuration, but is applicable to any X-ray tube configuration. For instance, in one embodiment the target and frame of the X-ray tube may be held at ground potential and the cathode may be maintained at the desired potential difference, while in another embodiment the X-ray tube may operate in a bipolar arrangement having a negative voltage applied to a cathode and a positive voltage applied to an anode.

An x-ray tube cathode provides an electron beam that is accelerated using a high voltage applied across a cathode-to-target vacuum gap to produce x-rays upon impact with the target. The area where the electron beam impacts the target is often referred to as the focal spot. Typically, the cathode includes one or more cylindrical coil or flat filaments positioned within a cup for providing electron beams to create a high-power, large focal spot or a high-resolution, small focal spot, as examples. Imaging applications may be designed that include selecting either a small or a large focal spot having a particular shape, depending on the application. Typically, an electrically resistive emitter or filament is positioned within a cathode cup, and an electrical current is passed therethrough, thus causing the emitter to increase in temperature and emit electrons when in a vacuum.

The shape of the emitter or filament and the shape of the cathode cup that the filament is positioned within affects the focal spot. In order to achieve a desired focal spot shape, the cathode may be designed taking the shape of the filament and cathode cup into consideration. However, the shape of the filament is not typically optimized for image quality or for thermal focal spot loading. Conventional filaments are primarily shaped as coiled or helical tungsten wires for reasons of manufacturing and reliability. Alternative design options may include alternate design profiles, such as a coiled D-shaped filament. Therefore, the range of design options for forming the electron beam from the emitter may be limited by the filament shape, when considering electrically resistive materials as the emitter source.

Electron beam (e-beam) wobbling is often used to enhance image quality. Wobble may be achieved using electrostatic e-beam deflection or magnetic deflection (i.e., spatial modulation), which utilizes a rapidly changing magnetic field to control the e-beam. Likewise, a rapidly changing magnetic field may be used to rapidly change the focusing of the electron beam (i.e., change the cross-sectional size of the electron beam in width and length directions). Typically, a pair of quadrupole magnets are used to achieve electron beam focusing in both width and length directions. For certain scan modes, such as rapid kV modulation, or so-called dual-energy scanning, the ability to rapidly adjust the focusing magnetic field is advantageous to maintain the focal spot size constant between the kV levels. Such electromagnetic e-beam control may achieve a high image quality by ensuring that the electron beam moves from one position to the next or refocuses as quickly as possible while staying in the desired position or at the desired focus without straying. However, when current in the electromagnets is rapidly changed to generate the changing magnetic field, eddy currents are generated in the vacuum vessel wall that opposes the magnetic field penetration inside the x-ray tube. The eddy currents increase the rise time of the magnetic field inside the throat of the x-ray tube, which slows the deflection or refocusing time of the e-beam. Accordingly, it would be desirable to design an x-ray tube having a throat portion that minimizes eddy current losses to optimize the transient magnetic field developed at the electron beam.

The configuration of the x-ray tube throat is subject to a number of design constraints. During operation, the throat experiences significant heat fluxes in the x-ray tube environment due to backscattered electrons from the target, for example. Further, the throat should be easy to manufacture and easy to join with interface components while still being capable of maintaining a hermetic vacuum and withstanding atmospheric pressure.

Therefore, it would be desirable to design an apparatus and method for improving the transient response in an electromagnetically controlled x-ray tube that satisfies the above-described design constraints and overcomes the aforementioned drawbacks.

BRIEF DESCRIPTION OF THE INVENTION

In accordance with one aspect of the invention, an x-ray tube assembly includes a vacuum enclosure that has a cathode portion, a target portion, and a throat portion. The throat portion includes a magnetic field section having an upstream end and a downstream end. The magnetic field section has a first susceptibility to generate eddy currents in the presence of a magnetic field intensity. The throat portion also has an upstream section having a first end and a second end. The first end of the throat portion is coupled to the cathode portion and the second end of the throat portion is coupled to the upstream end of the magnetic field section. The upstream section has a second susceptibility to generate eddy currents in the presence of the magnetic field intensity. The throat portion also has a downstream section that has a first end and a second end. The first end of the downstream section is coupled to the downstream end of the magnetic field section. The downstream section has a third susceptibility to generate eddy currents in the presence of the magnetic field intensity. The first susceptibility to generate eddy currents is less than the second and third susceptibilities to generate eddy currents. The x-ray tube assembly also includes a target positioned within the target portion of the vacuum enclosure, and a cathode positioned within the cathode portion of the vacuum enclosure, the cathode configured to emit a stream of electrons toward the target.

In accordance with another aspect of the invention, an x-ray tube assembly includes a housing having a vacuum formed therein. The housing includes a cathode portion, a target portion, and a throat portion. The throat portion includes a first section having a first wall thickness, a second section having a second wall thickness, and a first magnetic field section positioned between the first and second sections. The first magnetic field section has a third wall thickness that is thinner than the first and second wall thicknesses. The x-ray tube assembly also includes a target positioned in the target portion of the vacuum housing, and a cathode positioned in the cathode portion of the vacuum housing to direct a stream of electrons toward the target.

In accordance with another aspect of the invention, an imaging system includes a rotatable gantry having an opening therein for receiving an object to be scanned, a table positioned within the opening of the rotatable gantry and moveable through the opening, and an x-ray tube coupled to the rotatable gantry. The x-ray tube includes a vacuum chamber having a target portion housing a target, a cathode portion housing a cathode, and a throat portion. The throat portion has a first section having a first wall thickness, a second section having a second wall thickness, and a first magnetic field section coupled to the first and second sections. The first magnetic field section has a third wall thickness that is thinner than the first and second wall thicknesses. The imaging system also includes a first electron manipulation coil mounted on the x-ray tube and configured to generate a first magnetic field to manipulate a stream of electrons emitted from the cathode. The first electron manipulation coil is mounted on the x-ray tube and aligned with the first magnetic field section of the throat portion of the vacuum chamber such that a rise time of the first magnetic field is faster in the first magnetic field section than in the first and second sections.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

The operating environment of embodiments of the invention is described with respect to a computed tomography (CT) system. It will be appreciated by those skilled in the art that embodiments of the invention are equally applicable for use with any multi-slice configuration. Moreover, embodiments of the invention will be described with respect to the detection and conversion of x-rays. However, one skilled in the art will further appreciate that embodiments of the invention are equally applicable for the detection and conversion of other high frequency electromagnetic energy. Embodiments of the invention will be described with respect to a "third generation" CT scanner, but is equally applicable with other CT systems, surgical C-arm systems, and other x-ray tomography systems as well as numerous other medical imaging systems implementing an x-ray tube, such as x-ray or mammography systems.

Figure 1:
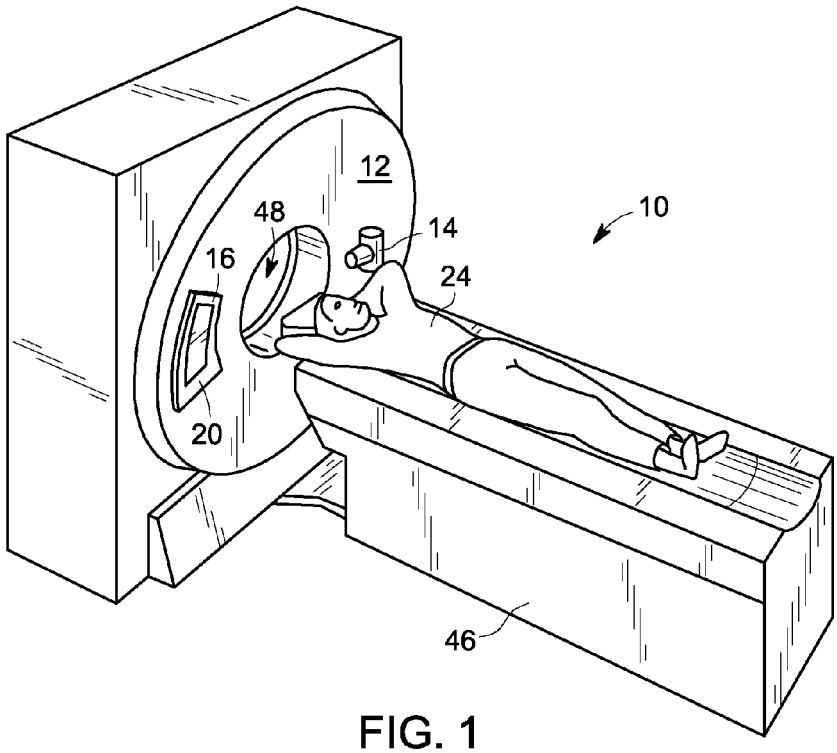
FIG. 1 is a pictorial view of an imaging system.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

Figure 2:
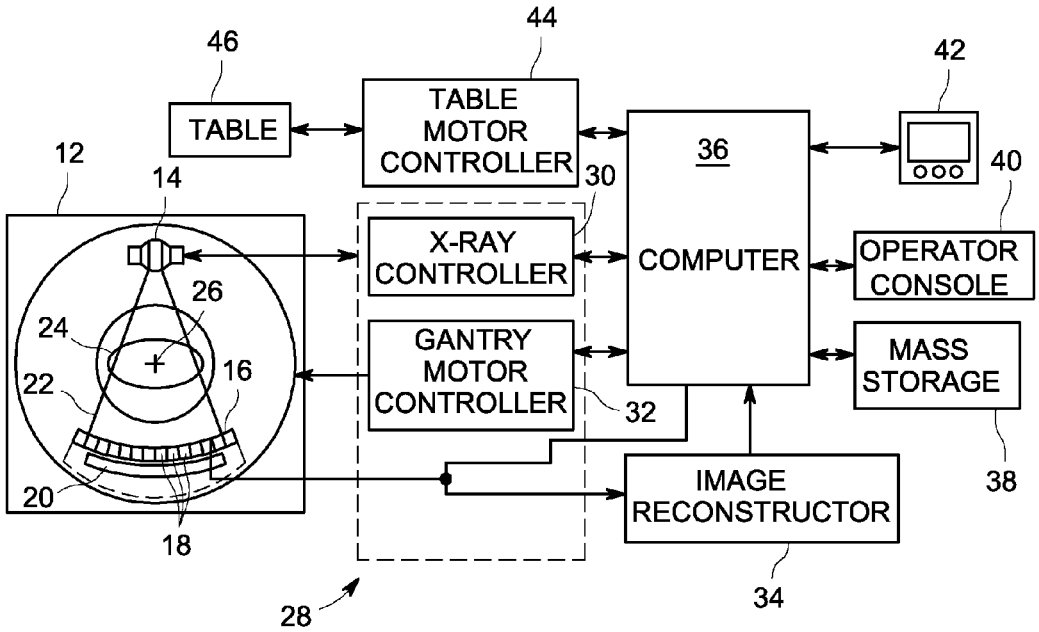
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray tube assembly or x-ray source assembly 14 that projects a cone beam of x-rays toward a detector assembly or collimator 16 on the opposite side of the gantry 12. Referring now to FIG. 2, detector assembly 16 is formed by a plurality of detectors 18 and data acquisition systems (DAS) 20. The plurality of detectors 18 sense the projected x-rays 22 that pass through a medical patient 24, and DAS 20 converts the data to digital signals for subsequent processing. Each detector 18 produces an analog electrical signal that represents the intensity of an impinging x-ray beam and hence the attenuated beam as it passes through the patient 24. During a scan to acquire x-ray projection data, gantry 12 and the components mounted thereon rotate about a center of rotation 26.

Rotation of gantry 12 and the operation of x-ray source assembly 14 are governed by a control mechanism 28 of CT system 10. Control mechanism 28 includes an x-ray controller 30 that provides power and timing signals to an x-ray source assembly 14 and a gantry motor controller 32 that controls the rotational speed and position of gantry 12. An image reconstructor 34 receives sampled and digitized x-ray data from DAS 20 and performs high speed reconstruction. The reconstructed image is applied as an input to a computer 36 which stores the image in a mass storage device 38. Computer 36 also has software stored thereon corresponding to electron beam positioning and magnetic field control, as described in detail below.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 20, x-ray controller 30 and gantry motor controller 32. In addition, computer 36 operates a table motor controller 44 which controls a motorized table 46 to position patient 24 and gantry 12. Particularly, table 46 moves patient 24 through a gantry opening 48 of FIG. 1 in whole or in part.

Figure 3:
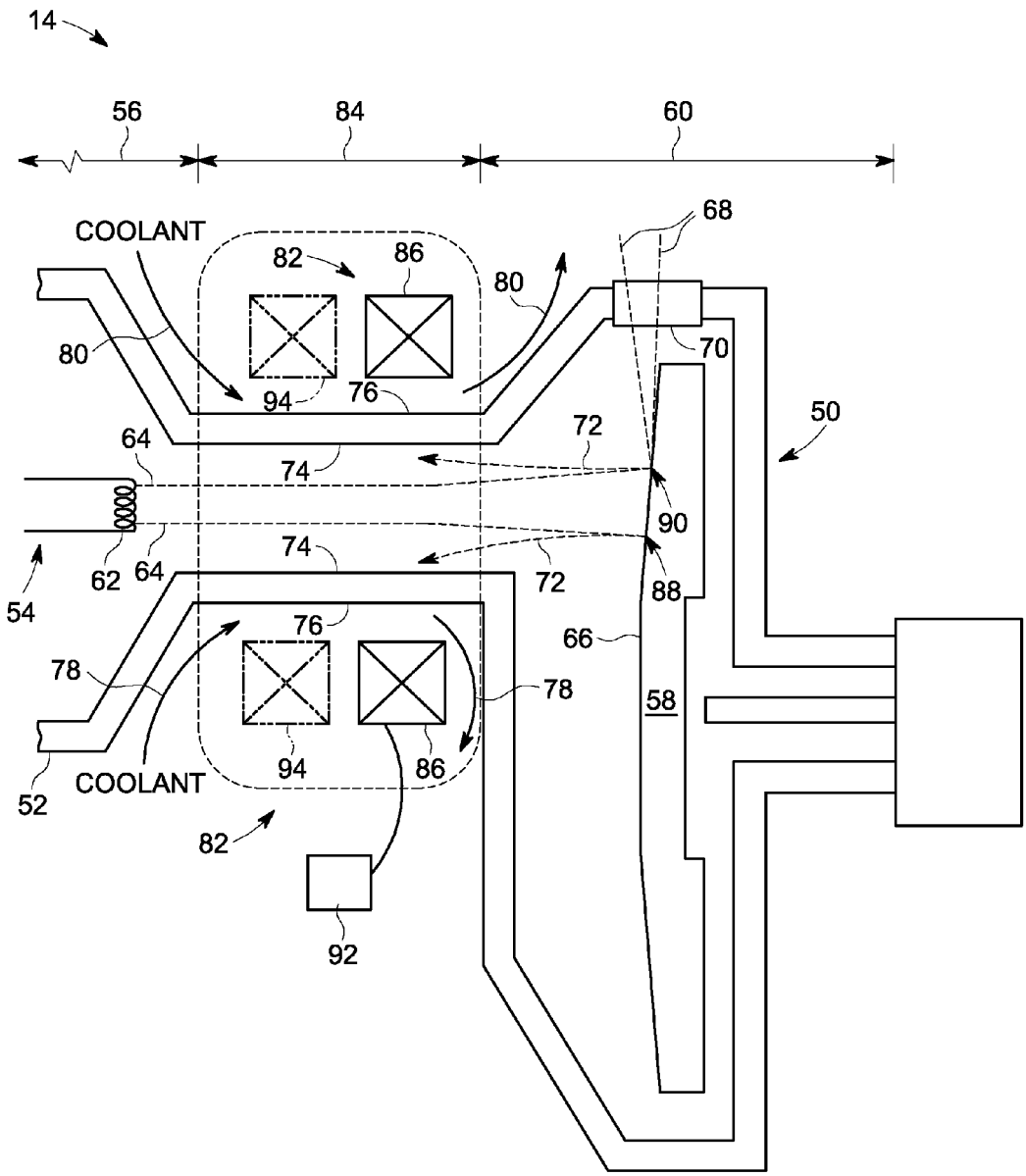
FIG. 3 is a cross-sectional view of an x-ray tube assembly according to an embodiment of the invention and useable with the imaging system illustrated in FIG. 1.

FIG. 3 illustrates a cross-sectional view of x-ray tube assembly 14 according to an embodiment of the invention. X-ray tube assembly 14 includes an x-ray tube 50 that includes a vacuum chamber or enclosure 52 having a cathode assembly 54 positioned in a cathode portion 56 thereof. A rotating target 58 is positioned in a target portion 60 of vacuum enclosure or housing 52. Cathode assembly 54 includes a number of separate elements, including a cathode cup (not shown) that supports a filament 62 and serves as an electrostatic lens that focuses a beam of electrons 64 emitted from heated filament 62 toward a surface 66 of target 58. A stream of x-rays 68 is emitted from surface 66 of target 58 and is directed through a window 70 of vacuum enclosure 52. A number of electrons 72 are backscattered from target 58 and impact and heat an inner surface 74 of vacuum enclosure 52. A coolant is circulated along an outer surface 76 of vacuum enclosure 52, as illustrated by arrows 78, 80 to mitigate heat generated in vacuum enclosure 52 by backscattered electrons 72.

A magnetic assembly 82 is mounted in x-ray tube assembly 14 at a location near the path of electron beam 64 within a throat portion 84 of vacuum enclosure 52, which is downstream from cathode portion 56 and upstream from target portion 60. Magnetic assembly 82 includes a first coil assembly 86. According to one embodiment, coil 86 is wound as a quadrupole and/or dipole magnetic assembly and is positioned over and around throat portion 84 of vacuum chamber 52 such that a magnetic field generated by coil 86 acts on electron beam 64, causing electron beam 64 to deflect and move along either the x- and/or y-directions. The direction of movement of electron beam 64 is determined by the direction of current flow though coil 86, which is controlled via a control circuit 92 coupled to coil 86. According to another embodiment, coil 86 is configured to control a focal spot size or geometry. Optionally, a second coil assembly 94 (shown in phantom) may also be included in magnetic assembly 82, as shown in FIG. 3. Coil assemblies 86, 94 may have dipole and/or quadrupole configurations, according to various embodiments and based on a desired electron beam control.

Embodiments of the invention set forth herein reduce the generation of eddy currents within the section of the x-ray tube throat 84 that is aligned with coil assemblies 86, 94, which allows the desired magnetic field to develop more rapidly. Eddy currents are developed in throat section 84 whenever the magnetic field is changing in magnitude, spatially or temporally. Eddy currents are not present when the magnetic field is unchanging. Consequently, the embodiments set forth herein are directed toward reducing the eddy current generation that would take place in a baseline metal throat section that is of a uniform cross-sectional thickness and volume, while simultaneously maintaining desired design specifications of throat section 84. Such design specifications may be, for example, that throat section 84 is hermetic, structurally robust to resist atmospheric pressure and other applied forces, thermally robust to heating primarily due to backscattered electrons, electrically conducting on an inside surface to provide a conduction path for collected charge, and joinable to cathode section 56 and target section 60 of vacuum enclosure 52.

Figure 4:
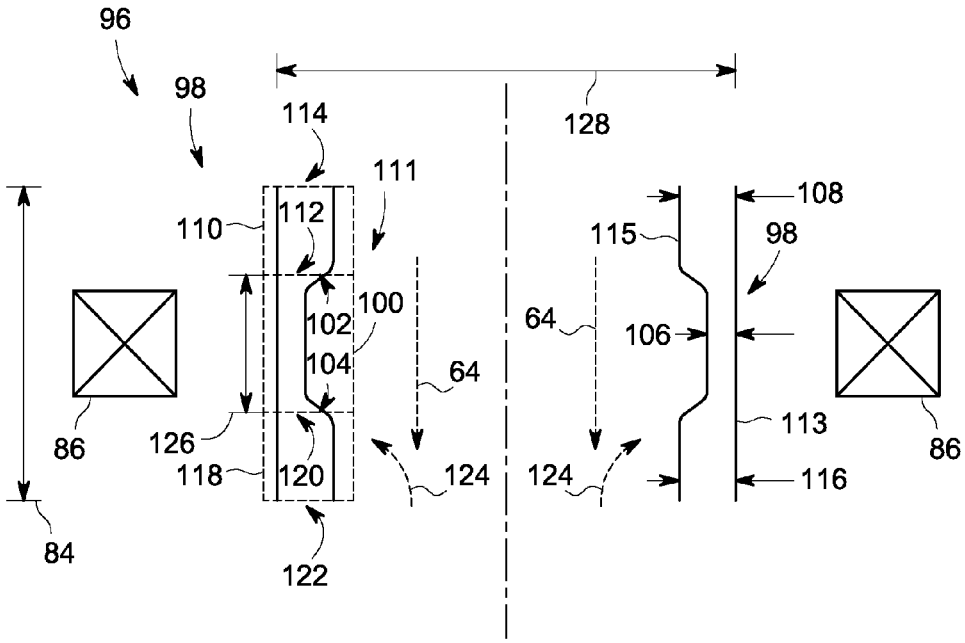
FIG. 4 is an enlarged portion of the throat of the x-ray tube assembly of FIG. 3, according to an embodiment of the invention.

FIG. 4 is an enlarged view of a subportion 96 of FIG. 3 that includes coil assembly 86 (FIG. 3) and a throat wall 98 that is a portion of throat 84 of vacuum enclosure 52 (FIG. 3), according to one embodiment of the invention. Vacuum wall 98 includes a magnetic field section 100, which has an upstream end 102 and a downstream end 104. Magnetic field section 100 is defined as an area of throat portion 84 between coil assembly 86 and beam of electrons 64 that experiences the primary magnetic field generated by coil assembly 86. In other words, magnetic field section 100 experiences the maximum magnetic flux density generated in throat portion 84 by coil assembly 86. As shown in FIG. 4, magnetic field portion 100 has a wall thickness 106 that is smaller than a wall thickness 108 of an upstream section 110 of wall 98, which is upstream of coil assembly 86. A first end 112 of upstream section 110 is coupled to upstream end 102 of magnetic field section 100, and a second end 114 of upstream section 110 is coupled to cathode portion 56 (FIG. 3). Likewise, wall thickness 106 of magnetic field section 100 is smaller than a wall thickness 116 of a downstream section 118 of wall 98. Downstream section 118 includes a first end 120 and a second end 122. As shown in FIG. 4, first end 120 is coupled to downstream end 104 of magnetic field section 100.

The eddy current magnitude developed in throat section 84 is proportional to the amount or thickness of the throat. Therefore, a thinner throat section where the magnetic flux density is highest will generate less eddy currents and therefore the magnetic field rise rate will be faster. Accordingly, because wall thickness 106 is less than thicknesses 108, a magnetic field generated by coil assembly 86 has a faster rise time in magnetic field section 100 than in upstream section 110. Likewise, because wall thickness 106 is less than thickness 116, the magnetic field generated by coil assembly 86 has a faster rise time in magnetic field section 100 than in downstream section 118. According to one embodiment, the decreased thickness of section 100 may result in a 50% improvement in the magnetic field rise time in magnetic field section 100 as compared to a metallic throat wall through having a uniform thickness. The larger thickness 116 of sections 110 and 118 allow for a more thermal and structurally sound vacuum throat.

Further, the thicker wall thickness 108 of non-magnetic field sections 110, 118 provides structural integrity to throat 84 and provides a larger mass of metal to absorb the heat from backscattered electrons 124. According to one embodiment, magnetic field section 100 has a wall thickness 106 of approximately 0.5 mm and a wall length 126 of approximately 1 cm. An outer diameter 128 of wall 98 is the same throughout magnetic field section 100 and upstream and downstream sections 110, 118. The thinned window section 106 is shown formed by material removed from the vacuum-side 111 of throat 84. This aids the throat cooling flow on the exterior of the vacuum throat by leaving a smooth outer surface 113. In alternative embodiment, the thinned section may be formed in the opposite manner, that is, with a smooth inner surface 115 and material removed from the outer surface 113. Wall 98 is a non-ferromagnetic material having a high electrical resistivity to minimize eddy current development, such as, for example, molybdenum alloys), stainless steel, or a titanium alloys, according to various embodiments. One skilled in the art will recognize that other materials of low electrical conductivity, high thermal conductivity and structural soundness may also be used.

Figure 5:
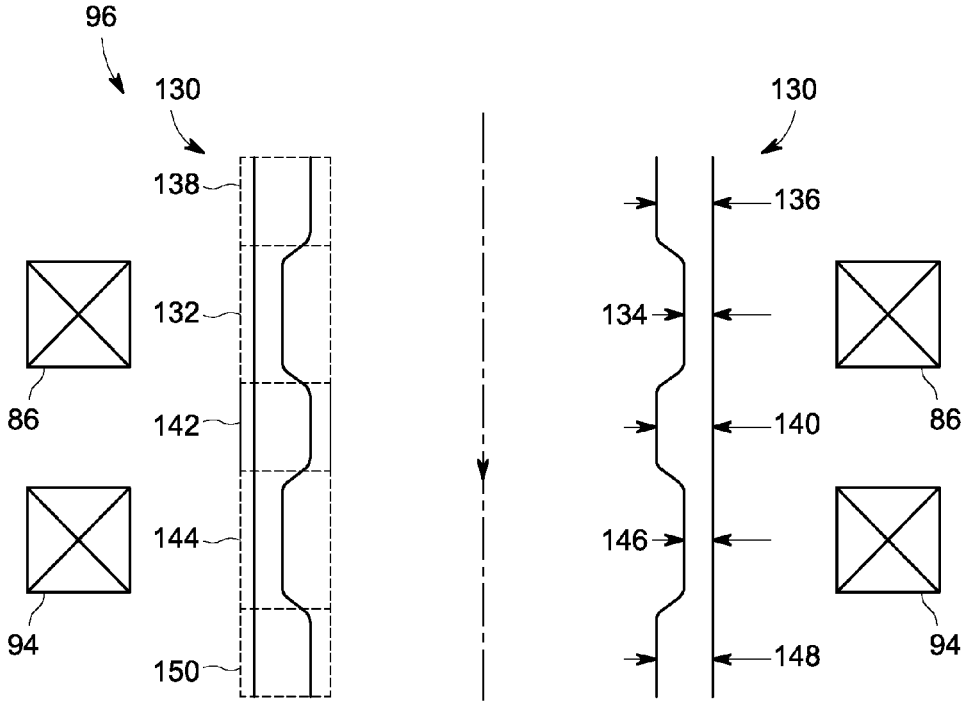
FIG. 5 is an enlarged portion of the throat of the x-ray tube assembly of FIG. 3, according to another embodiment of the invention.

Referring now to FIG. 5, an enlarged view of subportion 96 of FIG. 3 is shown according to an embodiment wherein magnetic assembly 82 (FIG. 3) includes two coil assemblies 86, 94. Wall 130 of throat portion 84 is configured in a similar manner as wall 98 of FIG. 4 such that a first magnetic field section 132, corresponding to coil assembly 86 has a wall thickness 134 that is less than a wall thickness 136 of a first section 138 and less than a wall thickness 140 of a second section 142, which are adjacent to first magnetic field section 132. Likewise, second magnetic field section 144 has a wall thickness 146 that is less than wall thickness 140 of second section 142 and less than a wall thickness 148 of a third section 150, which are adjacent to second magnetic field section 144, as shown in FIG. 5.

Figure 6:
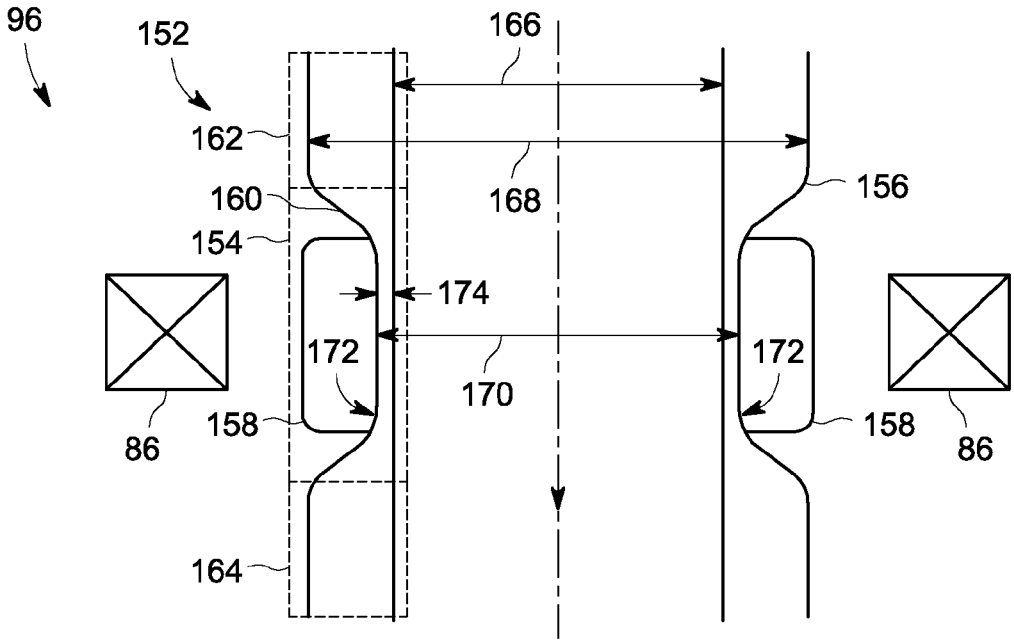
FIG. 6 is an enlarged portion of the throat of the x-ray tube assembly of FIG. 3, according to yet another embodiment of the invention.

FIG. 6 illustrates an enlarged view of subportion 96 of FIG. 3 according to another embodiment of the invention. Subportion 96 includes a throat wall 152 that has a magnetic field section 154 aligned with coil assembly 86. Unlike wall 98 (FIG. 4), wall 152 of FIG. 6 is constructed in two parts: a metal part 156 and a non-metal part 158. Metal part 156 includes a metal magnetic field section 160 and first and second sections 162, 164, which are adjacent to and upstream and downstream of metal magnetic field section 160, respectively, similar to wall 98 of FIG. 4. Metal part 156 has a substantially uniform inner diameter 166. An outer diameter 168 in first and second sections 162, 164 is larger than an outer diameter 170 of throat wall 152 in metal magnetic field section 160. Thus, wall 152 is thinner in magnetic field section 160 than in first and second sections 162, 164. In one embodiment, metal part 156 is a non-ferromagnetic material having a high electrical resistivity similar to prior described embodiments.

Non-metal part 158 of wall 152 comprises an insulator or electrically non-conducting material that is brazed or otherwise intimately joined onto an outside surface 172 of thinned areas of metal magnetic field section 160. According to various embodiments, non-metal part 158 may be graphite, alumina, aluminum nitride, or silicon nitride, as examples. Because non-metal part 158 provides structural support and additional thermal storage capacity for the thinned metal magnetic field section 174 of wall 152, metal magnetic field section 174 may be designed to be thinner than magnetic field portion 100 of FIG. 4. For example, according to one embodiment metal magnetic field section 160 has a wall thickness 174 of approximately 0.1-0.2 mm. By thinning throat wall 152 in metal magnetic field section 160, eddy current generation is minimized inside throat portion 84. Further, the thinned wall of metal magnetic field section 160 minimizes the ramp rate of the magnetic field inside throat 84, thereby improving deflection and/or focusing time of the electron beam.

According to one embodiment, non-metal part 158 is a continuous ring or donut of material surrounding non-magnetic field portion 154 of metal part 156. Alternatively, as shown in FIG. 7, non-metal part 158 may be a number of individual sections of non-metallic material inserted at locations on throat wall 152 proximate to individual poles 176 of a coil assembly, such as, for example coil assembly 86.

Figure 7:
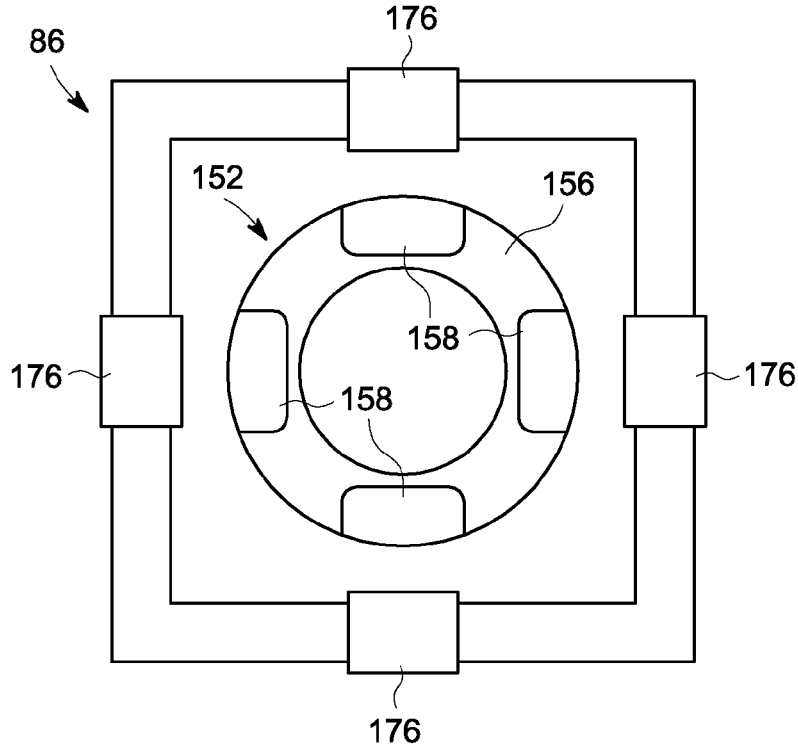
FIG. 7 is a cross-sectional view of the enlarged portion of FIG. 6, according to an embodiment of the invention.

While embodiments of subportion 96 of FIG. 3 are described in FIGS. 6 and 7 as including one coil assembly, one skilled in the art will recognize that such embodiments may be modified for an x-ray tube assembly having a pair of, or more, coil assemblies in a similar manner as described with respect to FIGS. 4 and 5 for focusing the electron beam in length and width directions and deflecting the electron beam along two axes.

Figure 8:
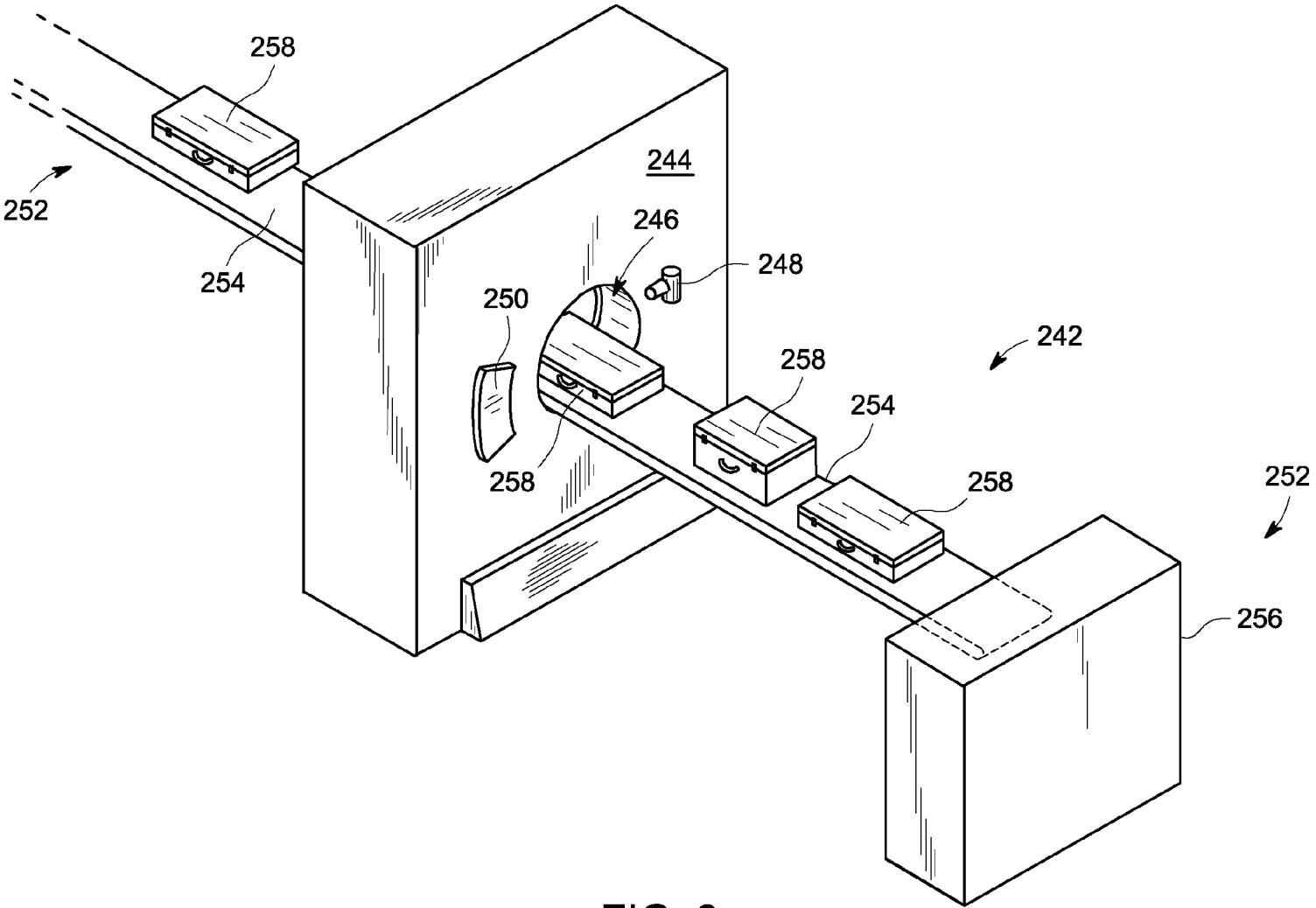
FIG. 8 is a pictorial view of an x-ray system for use with a non-invasive package inspection system according to an embodiment of the invention.

Referring now to FIG. 8, a package/baggage inspection system 242 includes a rotatable gantry 244 having an opening 246 therein through which packages or pieces of baggage may pass. The rotatable gantry 244 houses a high frequency electromagnetic energy source 248 as well as a detector assembly 250 having detectors similar to those shown in FIG. 2. A conveyor system 252 is also provided and includes a conveyor belt 254 supported by structure 256 to automatically and continuously pass packages or baggage pieces 258 through opening 246 to be scanned. Objects 258 are fed through opening 246 by conveyor belt 254, imaging data is then acquired, and the conveyor belt 254 removes the packages 258 from opening 246 in a controlled and continuous manner. As a result, postal inspectors, baggage handlers, and other security personnel may non-invasively inspect the contents of packages 258 for explosives, knives, guns, contraband, etc.

Therefore, in accordance with one embodiment, an x-ray tube assembly includes a vacuum enclosure that has a cathode portion, a target portion, and a throat portion. The throat portion includes a magnetic field section having an upstream end and a downstream end. The magnetic field section has a first susceptibility to generate eddy currents in the presence of a magnetic field intensity. The throat portion also has an upstream section having a first end and a second end. The first end of the throat portion is coupled to the cathode portion and the second end of the throat portion is coupled to the upstream end of the magnetic field section. The upstream section has a second susceptibility to generate eddy currents in the presence of the magnetic field intensity. The throat portion also has a downstream section that has a first end and a second end. The first end of the downstream section is coupled to the downstream end of the magnetic field section. The downstream section has a third susceptibility to generate eddy currents in the presence of the magnetic field intensity. The first susceptibility to generate eddy currents is less than the second and third susceptibilities to generate eddy currents. The x-ray tube assembly also includes a target positioned within the target portion of the vacuum enclosure, and a cathode positioned within the cathode portion of the vacuum enclosure. The cathode is configured to emit a stream of electrons toward the target.

In accordance with another embodiment, an x-ray tube assembly includes a housing having a vacuum formed therein. The housing includes a cathode portion, a target portion, and a throat portion. The throat portion includes a first section having a first wall thickness, a second section having a second wall thickness, and a first magnetic field section positioned between the first and second sections. The first magnetic field section has a third wall thickness that is thinner than the first and second wall thicknesses. The x-ray tube assembly also includes a target positioned in the target portion of the vacuum housing, and a cathode positioned in the cathode portion of the vacuum housing to direct a stream of electrons toward the target.

In accordance with yet another embodiment, an imaging system includes a rotatable gantry having an opening therein for receiving an object to be scanned, a table positioned within the opening of the rotatable gantry and moveable through the opening, and an x-ray tube coupled to the rotatable gantry. The x-ray tube includes a vacuum chamber having a target portion housing a target, a cathode portion housing a cathode, and a throat portion. The throat portion has a first section having a first wall thickness, a second section having a second wall thickness, and a first magnetic field section coupled to the first and second sections. The first magnetic field section has a third wall thickness that is thinner than the first and second wall thicknesses. The imaging system also includes a first electron manipulation coil mounted on the x-ray tube and configured to generate a first magnetic field to manipulate a stream of electrons emitted from the cathode. The first electron manipulation coil is mounted on the x-ray tube and aligned with the first magnetic field section of the throat portion of the vacuum chamber such that a rise time of the first magnetic field is faster in the first magnetic field section than in the first and second sections.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray tube assembly comprising:

a vacuum enclosure comprising:

a cathode portion;

a target portion; and a throat portion comprising:

a magnetic field section comprising an upstream end and a downstream end, the magnetic field section having a first susceptibility to generate eddy currents in the presence of a magnetic field intensity;

an upstream section having a first end and a second end, the first end coupled to the cathode portion and the second end coupled to the upstream end of the magnetic field section, wherein the upstream section has a second susceptibility to generate eddy currents in the presence of the magnetic field intensity;

a downstream section having a first end and a second end, the first end coupled to the downstream end of the magnetic field section, wherein the downstream section has a third susceptibility to generate eddy currents in the presence of the magnetic field intensity; and wherein the first susceptibility to generate eddy currents is less than the second and third susceptibilities to generate eddy currents;

a target positioned within the target portion of the vacuum enclosure; and a cathode positioned within the cathode portion of the vacuum enclosure, the cathode configured to emit a stream of electrons toward the target.

2. The x-ray tube assembly of claim 1 wherein the second susceptibility to generate eddy currents is approximately equal to the third susceptibility to generate eddy currents.

3. The x-ray tube assembly of claim 1 further comprising an electromagnetic coil positioned to surround and align with the magnetic field section of the throat portion of the vacuum enclosure.

4. The x-ray tube assembly of claim 1 wherein the magnetic field section has a wall thickness that is less than a wall thickness of the downstream section and less than a wall thickness of the upstream section.

5. The x-ray tube assembly of claim 4 further comprising an electrically insulating material coupled to the magnetic field section of the throat portion.

6. The x-ray tube assembly of claim 1 wherein the second end of the downstream section of the throat portion is coupled to the target portion of the vacuum enclosure.

7. The x-ray tube assembly of claim 1 wherein the throat portion further comprises:

a second magnetic field section having an upstream end and a downstream end, wherein the upstream end is coupled to the second end of the downstream section of the throat portion; and a second downstream section having a first end and a second end, wherein the first end is coupled to the downstream end of the second magnetic field second and the second end is coupled to the target portion.

8. The x-ray tube assembly of claim 7 further comprising:

a first electromagnetic coil positioned to center around the magnetic field section of the throat portion of the vacuum enclosure; and a second electromagnetic coil positioned to center around the second magnetic field section of the throat portion of the vacuum enclosure.

9. An x-ray tube assembly comprising:

a housing having a vacuum formed therein, the housing comprising:

a cathode portion;

a target portion; and a throat portion comprising:

a first section having a first wall thickness;

a second section having a second wall thickness; and a first magnetic field section positioned between the first and second sections, the first magnetic field section having a third wall thickness that is thinner than the first and second wall thicknesses;

a target positioned in the target portion of the vacuum housing; and a cathode positioned in the cathode portion of the vacuum housing to direct a stream of electrons toward the target.

10. The x-ray tube assembly of claim 9 wherein the throat portion further comprises:

a third section having a fourth wall thickness; and a second magnetic field section positioned between the second section and the third section, the second magnetic field section having a fifth wall thickness that is thinner than the first, second, and fourth wall thicknesses.

11. The x-ray tube assembly of claim 10 further comprising:

a first electromagnetic coil positioned around the throat portion of the housing, the first electromagnetic coil configured to generate a first magnetic field having a maximum magnetic flux density in the first magnetic field section of the throat portion; and a second electromagnetic coil positioned around the throat portion of the housing, the second electromagnetic coil configured to generate a second magnetic field having a maximum magnetic flux density in the second magnetic field section of the throat portion.

12. The x-ray tube assembly of claim 9 further comprising an electromagnetic coil positioned around the throat portion of the vacuum chamber, the electromagnetic coil configured to generate a magnetic field having a maximum magnetic flux density in the first magnetic field section of the throat portion.

13. The x-ray tube assembly of claim 12 wherein the electromagnetic coil comprises a plurality of poles; and wherein a non-conducting material is brazed to the outside surface of the first magnetic field section at a plurality of locations such that the non-conducting material is aligned with the plurality of poles.

14. The x-ray tube assembly of claim 9 further comprising a non-conducting material coupled to an outside surface of the first magnetic field section of the throat portion; and wherein the throat portion comprises a conducting material.

15. The x-ray tube assembly of claim 9 wherein the first magnetic field section has a wall thickness that is less than a wall thickness of the first and section sections.

16. An imaging system comprising:

a rotatable gantry having an opening therein for receiving an object to be scanned;

a table positioned within the opening of the rotatable gantry and moveable through the opening;

an x-ray tube coupled to the rotatable gantry, the x-ray tube comprising:

a vacuum chamber comprising:

a target portion housing a target;

a cathode portion housing a cathode; and a throat portion comprising:

a first section having a first wall thickness;

a second section having a second wall thickness; and a first magnetic field section coupled to the first and second sections, the first magnetic field section having a third wall thickness that is thinner than the first and second wall thicknesses; and a first electron manipulation coil mounted on the x-ray tube and configured to generate a first magnetic field to manipulate a stream of electrons emitted from the cathode, the first electron manipulation coil mounted on the x-ray tube and aligned with the first magnetic field section of the throat portion of the vacuum chamber such that a rise time of the first magnetic field is faster in the first magnetic field section than in the first and second sections.

17. The imaging system of claim 16 wherein the throat portion of the vacuum chamber further comprises:

a third section having a fourth wall thickness; and a second magnetic field section positioned between the second and third sections, the second magnetic field section having a fifth wall thickness that is thinner than the first, second, and third wall thicknesses; and wherein the x-ray tube further comprises a second deflection coil mounted on the x-ray tube adjacent to the first electron manipulation coil and configured to generate a second magnetic field to manipulate the stream of electrons, the second electron manipulation coil mounted on the x-ray tube and aligned with the second magnetic field section of the throat portion of the vacuum chamber such that a rise time of the second magnetic field is faster in the second magnetic field section than in the first, second, and third sections.

18. The imaging system of claim 16 further comprising a non-conducting material brazed to an outside surface of the first magnetic field section of the throat portion; and wherein the throat portion comprises a conducting material.

19. The imaging system of claim 18 wherein the first electron manipulation coil comprises a plurality of poles; and wherein the non-conducting material is brazed to the outside surface of the first magnetic field section at a plurality of locations such that the non-conducting material is aligned with the plurality of poles.

20. The imaging system of claim 17 wherein the first magnetic field section has a wall thickness that is less than a wall thickness of the first and section sections.

* * * * *

UNITED STATES PATENT AND TRADEMARK OFFICE

CERTIFICATE OF CORRECTION

PATENT NO. : 8,284,900 B2
APPLICATION NO. : 12/911893
DATED : October 9, 2012
INVENTOR(S) : Rogers et al.

It is certified that error appears in the above-identified patent and that said Letters Patent is hereby corrected as shown below:

Title Page, Item (75), Inventors, delete "Bangalore, IN (US);" and
substitute therefore -- Bangalore (IN); --.

In the Claims

Col. 11, line 12 (Claim 15), delete "section sections." and
substitute therefore -- second sections. --.

Col. 12, line 34 (Claim 20), delete "section sections." and
substitute therefore -- second sections. --.

Signed and Sealed this
Thirtieth Day of April, 2013

Teresa Stanek Rea
*Acting Director of the United States Patent and Trademark Office*